US012391466B2

(12) United States Patent
Fernandes De Carvalho et al.

(10) Patent No.: US 12,391,466 B2
(45) **Date of Patent: *Aug. 19, 2025**

(54) PORTION PACKAGING FOR PRODUCING A BEVERAGE

(71) Applicant: MELITTA SINGLE PORTIONS GMBH & CO. KG, Minden (DE)

(72) Inventors: Kerstin Fernandes De Carvalho, Bielefeld (DE); Jan Pahnke, Minden (DE); Holger Feldmann, Willich (DE)

(73) Assignee: MELITTA SINGLE PORTIONS GMBH & CO. KG, Minden (DE)

( * ) Notice: Subject to any disclaimer, the term of this patent is extended or adjusted under 35 U.S.C. 154(b) by 593 days.

This patent is subject to a terminal disclaimer.

(21) Appl. No.: 17/311,626

(22) PCT Filed: Jan. 17, 2020

(86) PCT No.: PCT/EP2020/051139

§ 371 (c)(1),
(2) Date: Jun. 7, 2021

(87) PCT Pub. No.: WO2020/152049

PCT Pub. Date: Jul. 30, 2020

(65) Prior Publication Data

US 2022/0024685 A1 Jan. 27, 2022

(30) Foreign Application Priority Data

Jan. 22, 2019 (DE) ..... 10 2019 101 533.2

(51) Int. Cl.
*B65D 85/80* (2006.01)
*B65D 85/804* (2006.01)

(52) U.S. Cl.
CPC ..... *B65D 85/8061* (2020.05)

(58) Field of Classification Search
CPC ..... B65D 85/8043; B65D 85/804; B65D 85/8046; B65D 85/8061; B65D 5/46; A45C 11/20
See application file for complete search history.

(56) References Cited

U.S. PATENT DOCUMENTS 4,863,601 A * 9/1989 Wittekind ..... A47J 31/02 206/0.5
4,867,993 A * 9/1989 Nordskog ..... A47J 31/02 426/82

(Continued)

FOREIGN PATENT DOCUMENTS

DE 4338628 A1 5/1995
DE 102018101333 A1 7/2019

(Continued)

OTHER PUBLICATIONS

International Search Report in corresponding International Patent Application No. PCT/EP2020/051139, mailed Jun. 2, 2020, 5 pages with English Translation.

(Continued)

*Primary Examiner* — Ericson M Lachica
(74) *Attorney, Agent, or Firm* — FisherBroyles, LLP; Robert Kinberg

(57) ABSTRACT

A portion packaging for producing a beverage, in particular coffee, includes a container made of a filter material in which an extraction material is arranged and a support body which is connected to the filter material. The support body has multiple pivotal arms which can be pivoted from a position which closes the container and into a position which opens the container. The pivotal arms of the support body are arranged one above the other on at least two planes when the portion packaging is closed.

7 Claims, 15 Drawing Sheets

(56) References Cited

U.S. PATENT DOCUMENTS 4,917,291 A * 4/1990 Saiki ..... B65D 75/14 229/922
5,358,175 A * 10/1994 Cai ..... B65D 3/08 229/128
5,676,306 A * 10/1997 Lankin ..... B65D 3/20 229/5.5
9,764,891 B1 * 9/2017 Aviles ..... B65D 85/8061
11,511,932 B2 * 11/2022 Fernandes De Carvalho ..... B65D 85/8061
11,548,721 B2 * 1/2023 Fernandes De Carvalho ..... B65D 85/8061
2004/0261370 A1 * 12/2004 Rea ..... B29C 66/3452 53/562
2005/0051478 A1 * 3/2005 Karanikos ..... B65D 85/8061 210/477
2009/0114710 A1 * 5/2009 Lang ..... B65D 3/20 229/404
2009/0261152 A1 * 10/2009 Abbott ..... B65D 3/06 229/4.5
2013/0327223 A1 * 12/2013 Bartoli ..... A47J 31/3676 426/115
2015/0110928 A1 * 4/2015 Kihnke ..... B65D 85/8061 426/115
2015/0166257 A1 * 6/2015 Trombetta ..... B65D 85/8043 426/115
2015/0291347 A1 * 10/2015 Rivola ..... B65B 61/08 426/77
2015/0314955 A1 * 11/2015 Savage ..... B65D 65/466 426/115
2015/0368033 A1 * 12/2015 Krug ..... A47J 31/407 426/112
2016/0001903 A1 * 1/2016 Bartoli ..... B65B 29/02 426/112
2016/0325898 A1 * 11/2016 Footz ..... B65D 85/8061
2017/0355515 A1 * 12/2017 Marcinkowski ..... A47J 31/407
2018/0050861 A1 * 2/2018 Rivera ..... A47J 31/0684
2019/0077536 A1 * 3/2019 Chan ..... B65D 3/04
2020/0140186 A1 * 5/2020 Lee ..... B65D 85/8043
2020/0352387 A1 * 11/2020 Malkin ..... A23F 5/262

FOREIGN PATENT DOCUMENTS

EP 0268847 A1 6/1988
EP 1418135 A2 5/2004
EP 2752375 A1 7/2014
GB 1575845 A * 10/1980 ..... B65D 85/808
GB 2256415 A * 12/1992 ..... B65B 29/02
WO 2015065813 A1 5/2015
WO 201958141 A1 3/2019

OTHER PUBLICATIONS

German Search Report in corresponding German Patent Application No. 10 2019 101 533.2, received Oct. 18, 2019, 13 pages with English Google Translation.

* cited by examiner

PORTION PACKAGING FOR PRODUCING A BEVERAGE

CROSS-REFERENCE TO RELATED APPLICATIONS

This application is a United States National Stage Application of International Application No. PCT/EP2020/051139 filed Jan. 17,2020, claiming priority from German Patent Application No. 102019101533.2 filed Jan. 22, 2019.

FIELD OF THE INVENTION

The present invention relates to a portion packaging for producing a beverage, in particular coffee, comprising a container made of filter material in which an extraction material is arranged, and a support body which is connected to the filter material, wherein the support body has a plurality of pivotable arms which are pivotable from a position which closes the container into a position which opens the container.

BACKGROUND

EP 268 847 B1 discloses a coffee filter which has a holding frame which can be placed on a vessel and to which a filter bag open at the top is fixed. For brewing coffee, the filter bag is filled with coffee grounds and can then be brewed by hand. Filling the filter bag and brewing is comparatively time-consuming.

Closed portion packages are also known for the production of coffee, as disclosed for example in EP 1 418 135 A2. Coffee grounds are inserted into a liquid-permeable filter material, which can then be flushed with hot water to prepare coffee. Such portion packages have the disadvantage that the coffee grounds cannot expand sufficiently during the brewing process and, in addition, the fresh coffee aroma is retained in the machine.

DE 10 2018 101 333 A1 discloses a portion packaging comprising a container of filter material surrounded by a support body. The container is closed at the top by a plurality of flaps, wherein each flap is locked by mechanical locking means to an adjacent flap in the manner of a rosette closure, wherein the flaps are arranged in the locked position in a jointly formed plane.

SUMMARY

Therefore, it is an object of the present invention to provide a portion packaging for preparing a beverage, which is to be opened for beverage preparation and is stably arranged in the closed position.

The above and other objects are solved with a portion packaging for production of a beverage from an extraction material, comprising: a container made of filter material, in which the extraction material is to be arranged; and a support body connected to the filter material, wherein the support body includes a plurality of pivotable arms which are pivotable from a closed position closing the container into an open position for opening the container, and wherein the pivotable arms of the support body are arranged on top of one another in at least two planes in the closed position of the container.

As a result of the invention, the closure of the portion packaging can be designed to be particularly stable since the arms reinforce each other in the different planes. The arms can thereby be arranged on lop of each other, at least in certain areas, so that the portion packaging can withstand high impact loads without being opened accidentally. This improves the handling of the portion packaging, which can be dropped from a usual height in the filled position without being opened accidentally.

The arms forming a common plane are preferably interlocked and held together, but do not lie loosely on top of each other. Two arms lying loosely on top of each other are arranged in two different planes.

Preferably, the arms have a locking element at the end. For example, a mechanical locking device can serve as the locking mechanism, wherein at least two arms are locked together in each case. The locking can be effected mechanically by frictional forces, wherein the locking elements can be pivoted together along guide edges of the locking elements for opening. This provides a mechanical fixation of the arms in the closed position, but allows a uniform joint opening of the arms for a brewing operation. Both ecologically and economically, it makes sense to design the locking mechanism from the materials of the portion packaging. Optionally, additional parts, such as stickers or adhesive dots, can also be used to fix at least part of the arms together above, for example, the arms arranged in the uppermost level.

In a preferred design, in the closed position of the portion packaging, the interlocking locking elements of at least two arms are arranged in a first plane above the interlocking locking elements of two further arms in a second plane. Even if the arms in the outer plane are slightly opened during an impact load, the arms in the second plane can keep the container closed to prevent spillage of the extraction material.

The portion packaging is preferably pyramid-shaped in the closed position. In this case, the pivotable arms are provided on the side opposite to a tip of the pyramid. Each arm may be formed as a substantially triangular flap which, in the open position, exposes an opening of the container.

The support body may be formed in one piece, and each arm may be connected to a lateral section of the support body via a folded edge. The support body can be arranged annularly around the outside of the filter material or alternatively inside the filter material.

If the support body is made of cardboard, an opening process of the portion packaging can be carried out by applying a liquid, in particular hot water. The wetting of folded edges can then initiate a swelling process that leads to deformation and pivoting open of the arms or flaps. In the case of a swellablc material, such as cardboard or a thick paper, the swelling process can cause a corresponding pivoting movement at the folding edge. The arms can be connected to the filter material, in particular glued, so that the filter material is pivoted together with the arms or flaps into an open position.

BRIEF DESCRIPTION OF THE DRAWINGS

The invention is explained in more detail below by means of an exemplary embodiment with reference to the accompanying drawings, wherein.

DETAILED DESCRIPTION OF THE INVENTION

Figure 1:
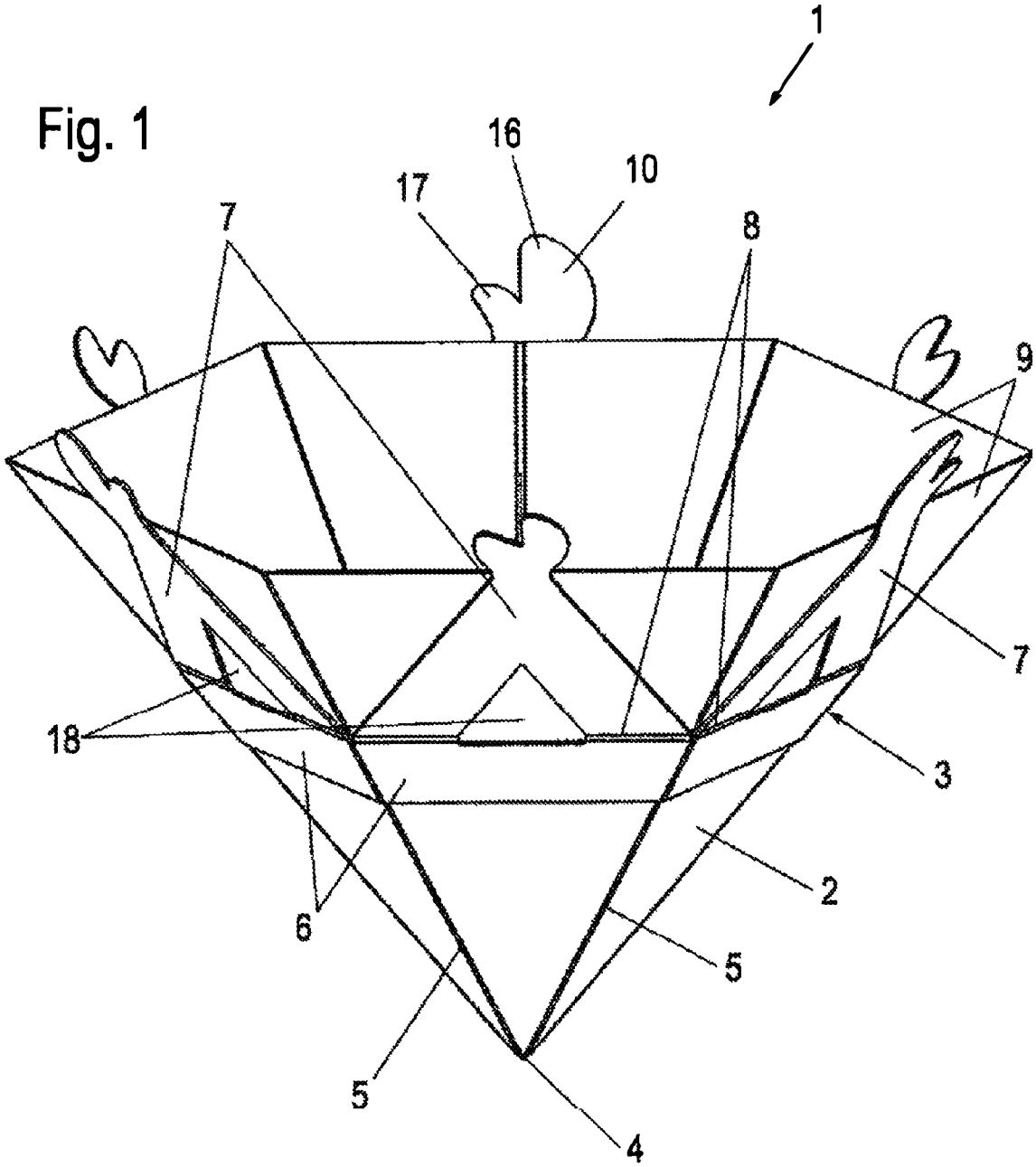
FIG. 1 shows a perspective view of a portion packaging in an open position.

A portion packaging 1 comprises a container 2 of filter material, shown open in FIG. 1, around which a support body 3 is arranged in an annular shape. The container 2 is made of a liquid-permeable filter material, in particular a filter paper. The container 2 is essentially pyramid-shaped having a tip 4 arranged at the bottom in the position of use, from which several side walls made of filter material are arranged spreading upwards, which are connected to each other via side edges 5.

The support body 3 can be made of cardboard or a thicker paper and comprises lateral sections 6 which can be connected to the filter material of the container 2 at the side edges, for example by gluing. In this case, the lateral sections 6 are strip-shaped and are arranged only in an upper region of the side walls, so that adjacent to the tip 4 the filter material is not covered by the sections 6.

The support body 3 comprises arms 7 which can be pivoted at the lateral sections 6, each of which is connected to a lateral section 6 via a folding edge 8. In the illustrated exemplary embodiment, six arms 7 are provided, which are formed as substantially triangular flaps and surround an interior space of the container 2 in the manner of a hexagon. A section 9 of filter material is fixed to the arms 7, for example by bonding, so that when the arms 7 are moved the section 9 of filter material is also pivoted. A recess 18 is provided on each arm 7 to facilitate opening. It is also possible to dispense with a recess 18 in the area of the arms 7.

A locking element 10 is provided at the end of each arm 7, which has a guide edge 16 and a latching projection 17. The locking elements 10 of two, three or four arms 7 can be locked together by folding the locking elements 10 into one another to become interlocked with one another, thus forming a locking mechanism.

The container 2 contains an extraction material, in particular coffee grounds or tea.

Figure 2:
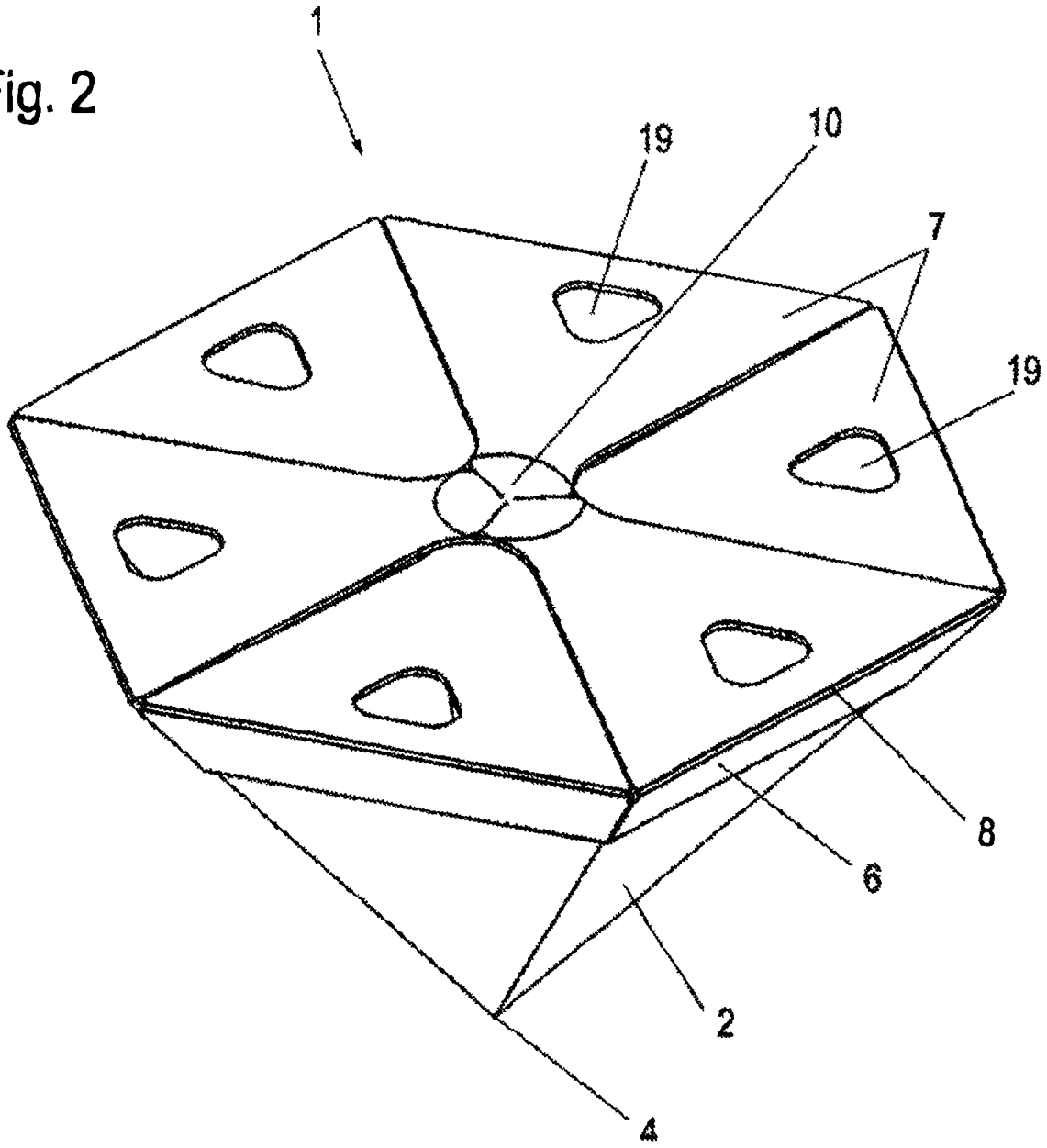
FIG. 2 shows a perspective view of a portion packaging in a closed position.

In FIG. 2, the portion packaging 1 is shown in a closed position in which it is of pyramid-shaped design. The portion packaging 1 can thus be inserted into a machine for preparing a brewed beverage. Compared to FIG. 1, recesses 19 do not extend to the folding edge 8, but are formed somewhat smaller. In all other respects the embodiment example corresponds to FIG. 1.

The opening process is explained in more detail with reference to FIGS. 3 to 7. To open the portion packaging 1, the arms 7 can be opened either manually or by applying a liquid, in particular hot water, which leads to swelling processes on the support body 3 in the area of the folding edges 8 and causes automatic opening.

Figure 3:
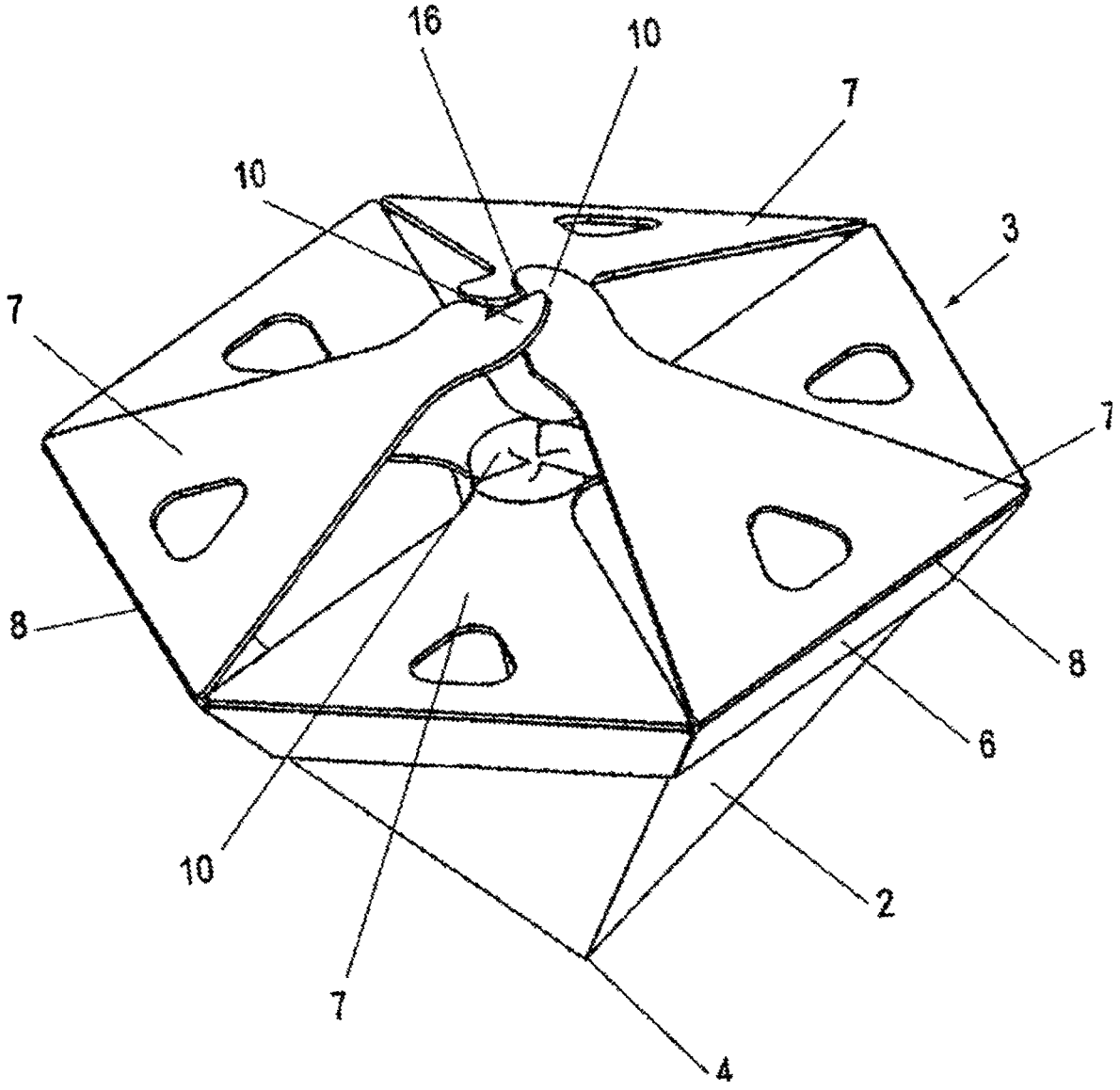
FIGS. 3 to 7 show several views of the portion packaging of FIG. 1 during an opening process.

In FIG. 3, three arms 7 have been opened slightly, and it can be seen that these three arms 7 overlap each other in the area of the elements 10 and can be pivoted together around the respective folding edges 8. In the process, the locking elements 10 are unlocked from one another and slide along the guide edges 16. Three further arms 7 are still in the closed locked position in FIG. 3, so that in this position coffee grounds are prevented from escaping through the three closed arms 7. To explain the opening process, the filter material has been omitted in the area of the arms 7 in FIGS. 3 to 7.

Figure 4:
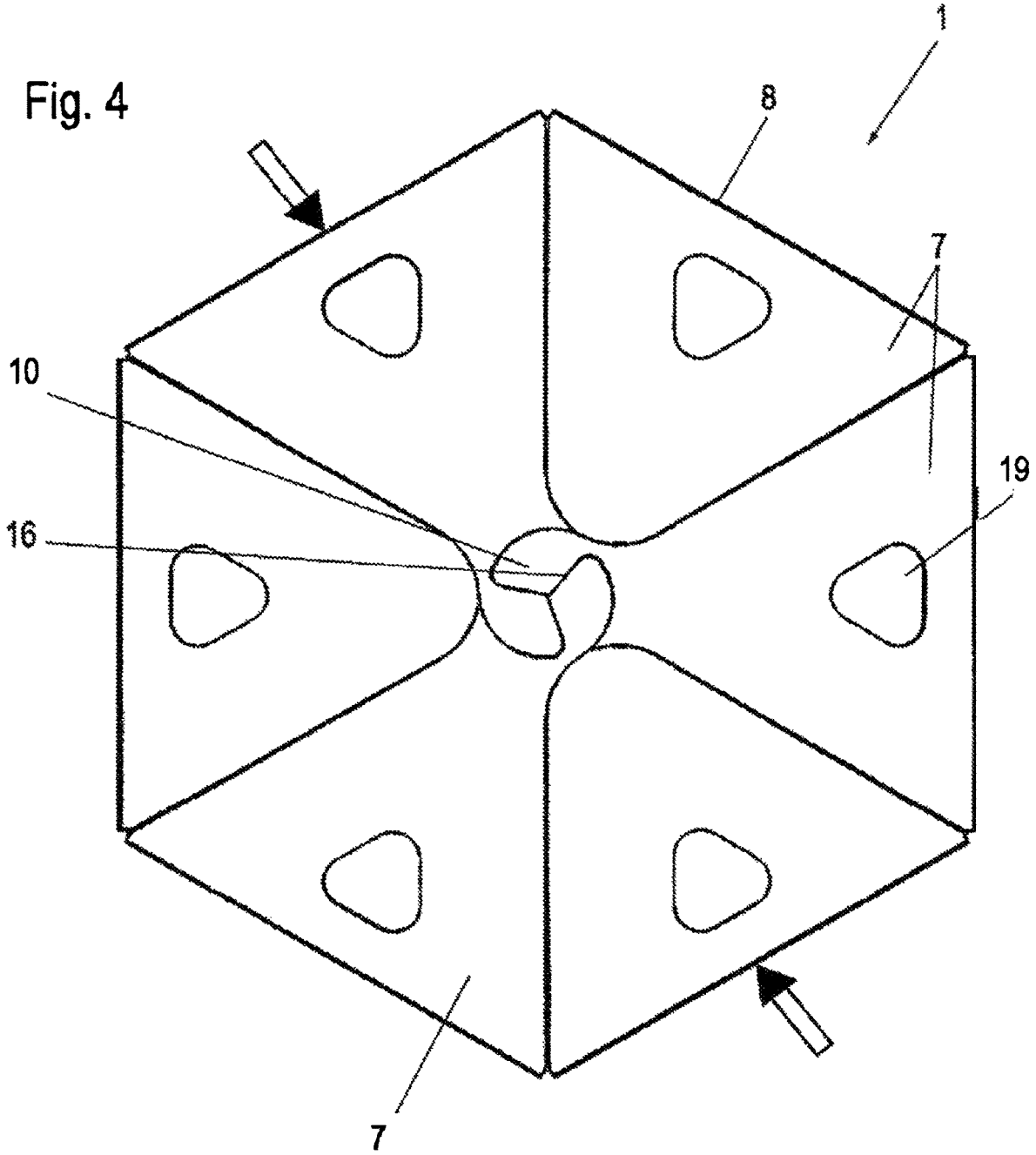

In FIG. 4, the portion packaging 1 of FIG. 3 is shown in a top view. If the portion packaging 1 is subjected to an impact or pressure load, as symbolized by the arrows, it may be possible to cause the three upper arms 7 to open, the interlocking elements 10 of which are arranged above the interlocking elements 10 of the three lower arms 7 in the closed position. The portion packaging 1 nevertheless remains closed, since the locking elements 10 of the three lower arms 7 remain locked. In the event of torsion due to shear load, either the interlocked locking elements 10 of the lower or the upper arms 7 stabilize the locking mechanism, depending on the direction, since the guide edges 16 and the latching projections 17 are oriented in each case alternately in one and the other direction.

Figure 9:
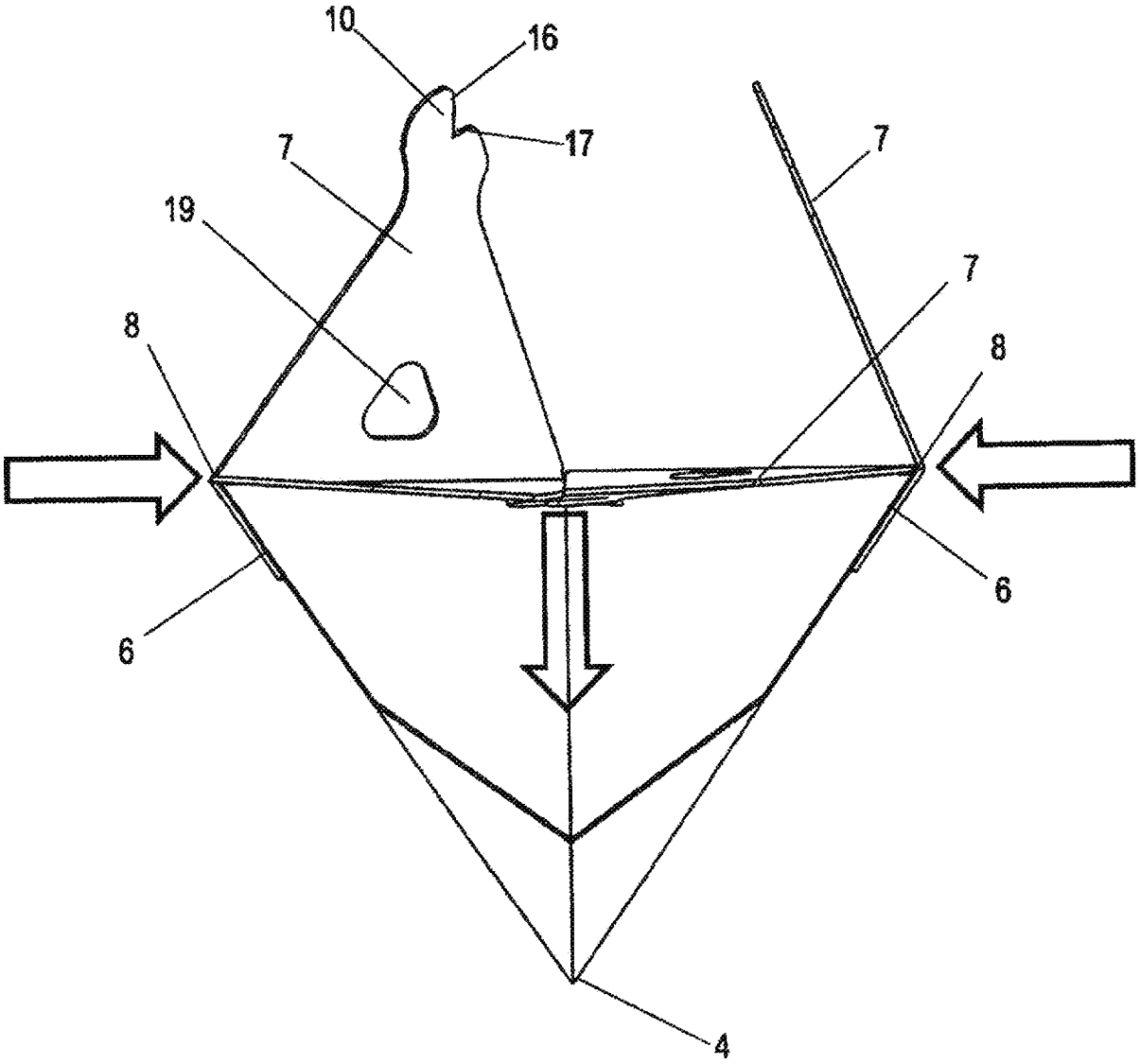
FIG. 9 shows a sectional view of the portion packaging in a partially opened position.

In a particularly advantageous design, the latched arms are inclined slightly inward as shown in FIG. 9. This allows pressure loads on the support body 3 to be easily dissipated inwardly. Even a partially opened portion packaging 1 can therefore withstand high pressure loads without opening, since the arms 7 can support themselves inwardly on the extraction material. This effect is further enhanced if the interlocking locking elements of both planes are oriented inwards.

Figure 5:
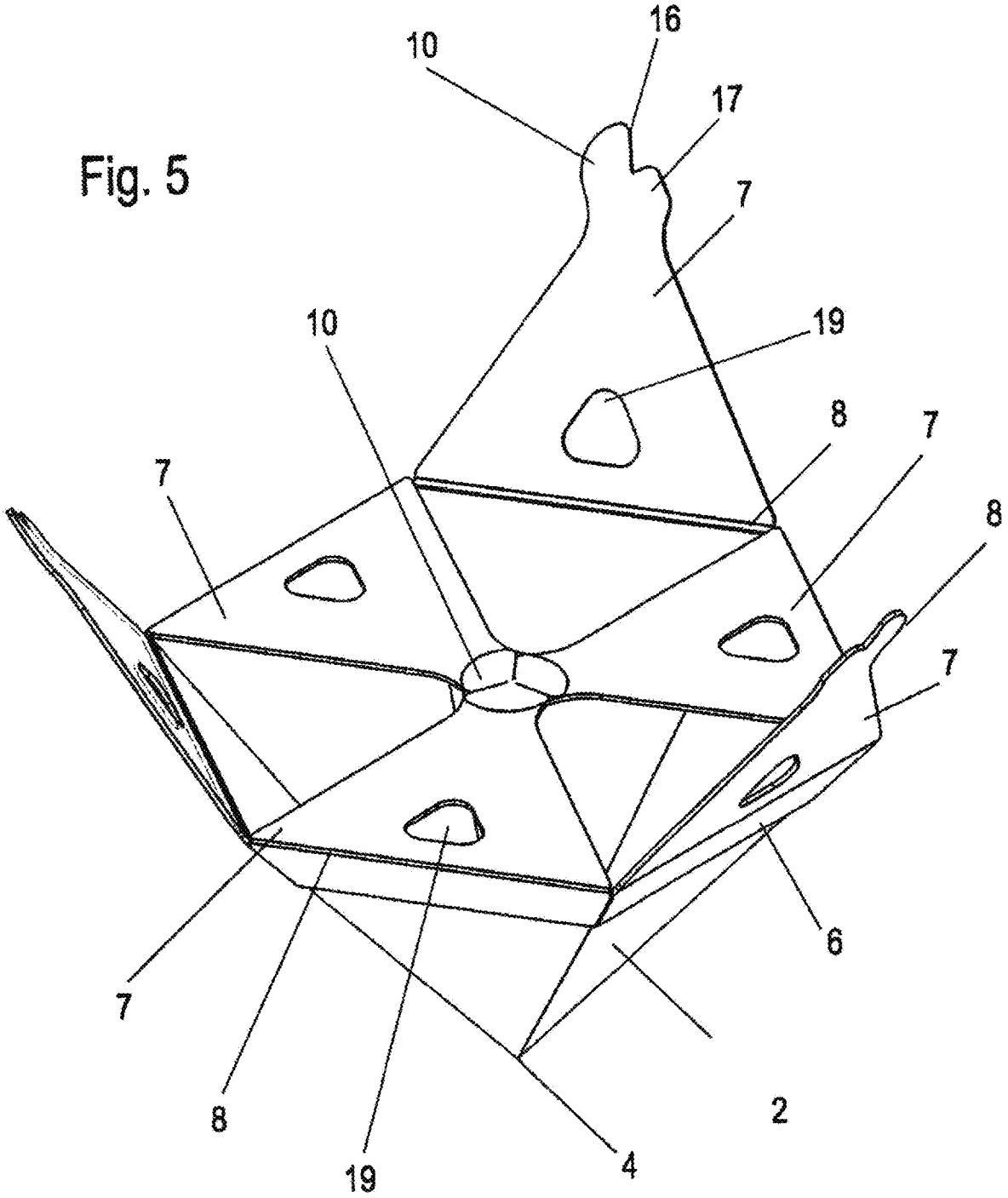

In FIG. 5, the three arms 7 have been pivoted by more than 90°, while the three lower arms 7 are still locked via the interlocking locking elements 10. It can be seen that the three lower arms 7 still substantially close the container 2, wherein the filter material in the area of the lower arms 7 additionally seals the opening on the portion packaging 1.

Figure 6:
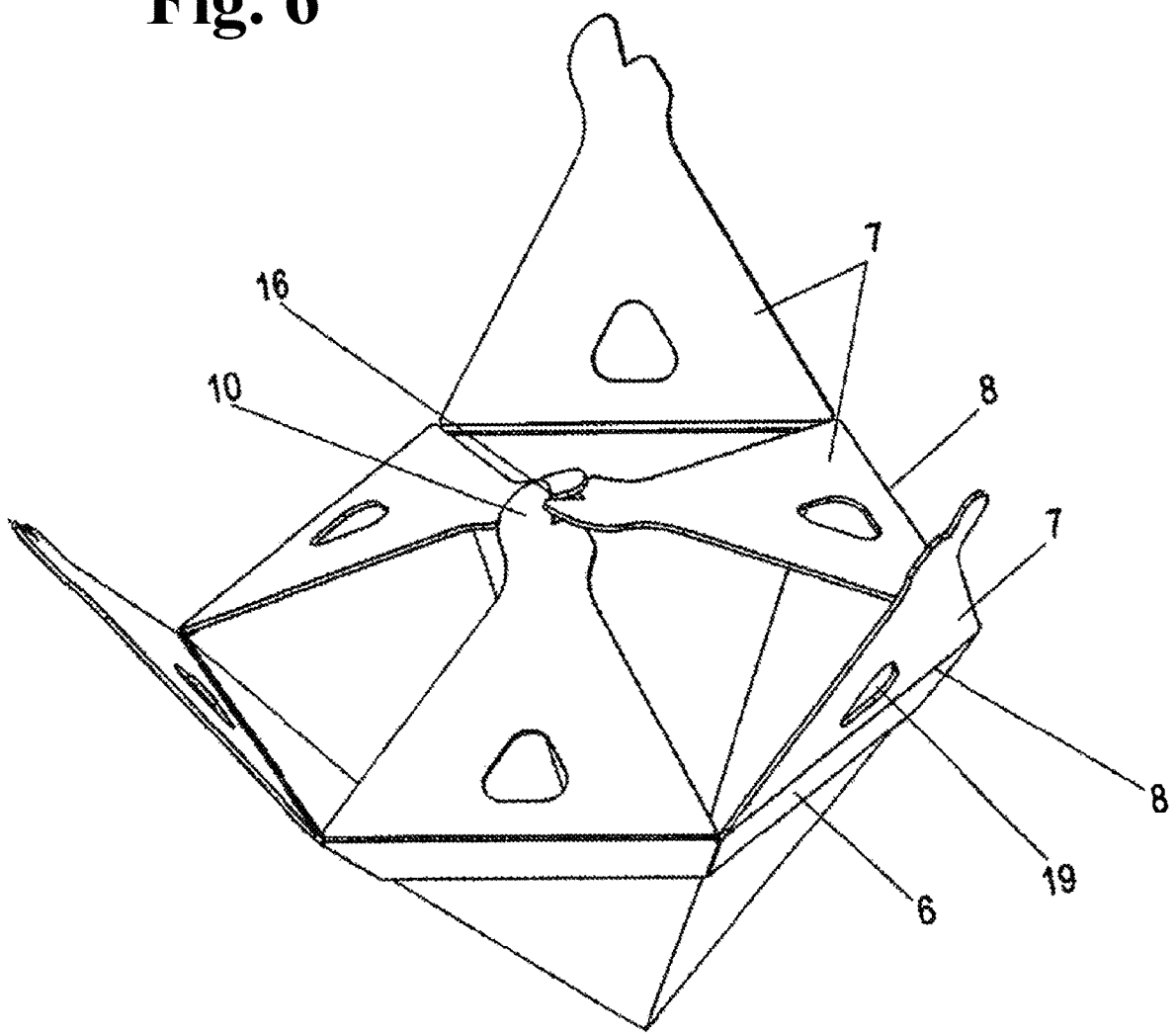
Figure 7:
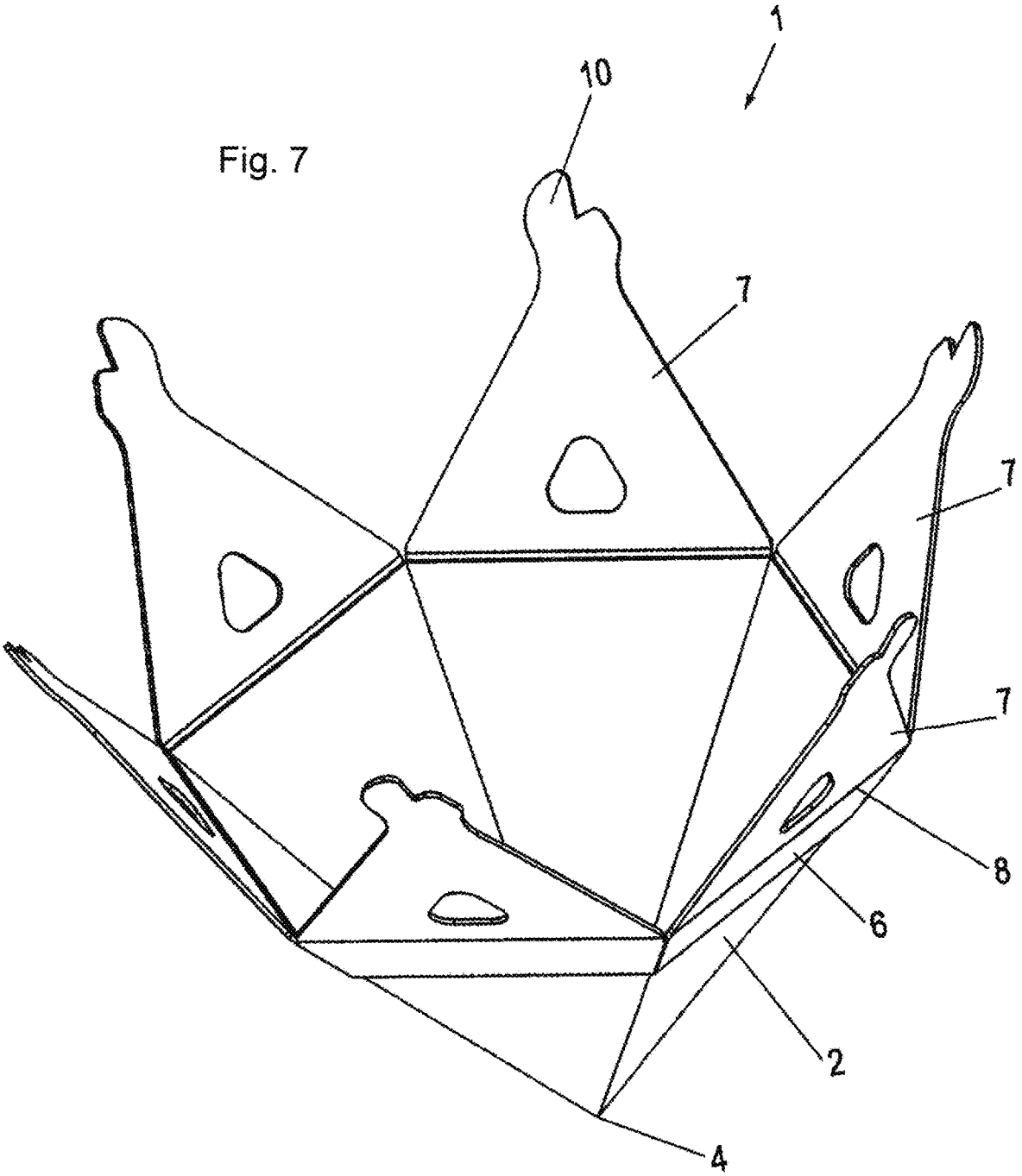

In FIG. 6, the lower arms 7 are shown in a slightly open position in which the interlocking locking elements 10 are unlocked. In FIG. 7, the portion packaging 1 is shown in a fully open position, wherein no filter material is shown in the area of the arms 7 so as to better see the opening mechanism. In addition, the portion packaging 1 is also not filled with extraction material.

When the portion packaging 1 is opened by a liquid via swelling processes, the six arms 7 are opened substantially simultaneously, wherein the arms 7 are opened with the upper interlocking locking elements 10, which are arranged above the interlocking locking elements 10 of the lower arms 7, only just before the lower arms 7. The swelling processes then cause the arms 7 to pivot substantially simultaneously.

Figure 8:
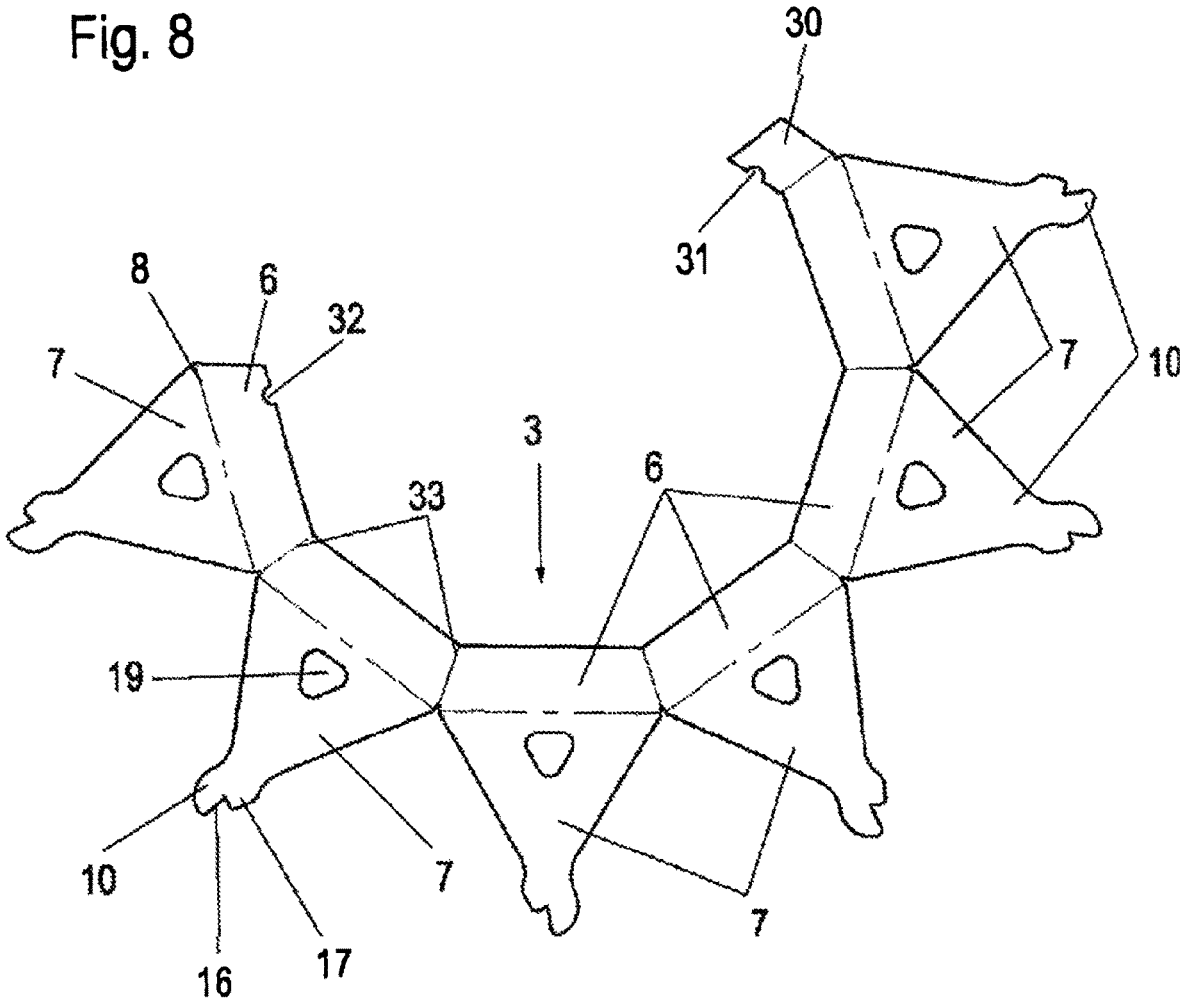
FIG. 8 shows a view of the blank of the support body for the portion packaging of FIGS. 2 to 7.

FIG. 8 shows a blank of the support body 3. The support body 3 is manufactured as an integral component from cardboard and comprises six arms 7, each of which is connected to a lateral section 6 via folding edges 8. The lateral sections 6 can be folded annularly along folding edges 33, wherein a connecting web 30 is formed on an end section 6 which can be connected to an opposite lateral section 6, for example by gluing. A recess 31 is provided on the connecting web 30. which can be made to coincide with a recess 32 on an end-side lateral section 6 for alignment of the support body 3 during bonding. The blank of filter material may also be made in one piece and bonded together along a connecting portion or joined by embossing to form a bag-shaped container 2. The support body 3 is preferably provided on the outside of the filter material, but optionally it may be provided on an inner side of the filter material. Furthermore, the number of arms 7 can also be varied.

It is also possible to connect the support body 3 to the filter material only in the area of the arms 7, in particular by gluing, and to arrange the lateral sections 6 only loosely around the filter material. In this case, any influence of adhesive on the taste of the brewed beverage is reliably avoided.

Figure 10A:
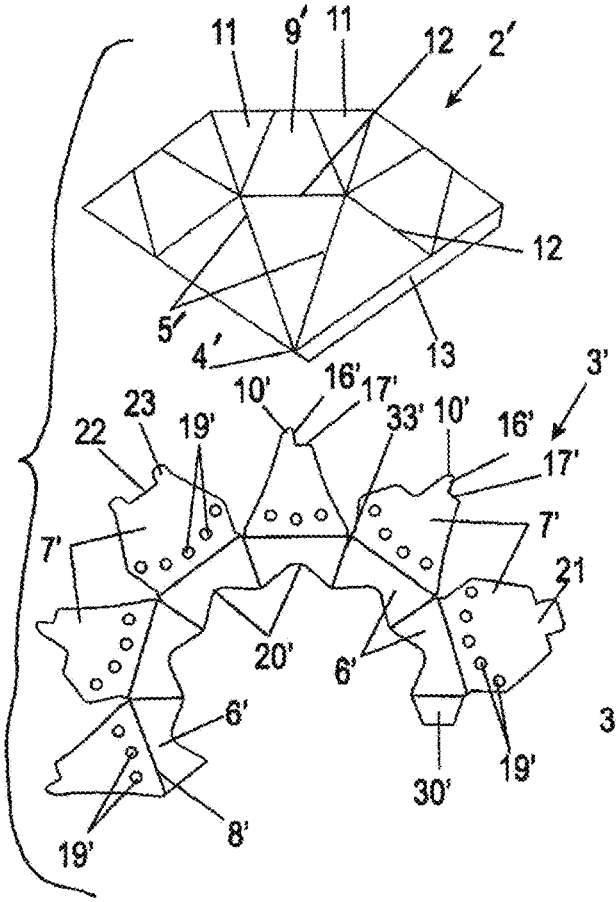
FIGS. 10A to 10I show several views of a further exemplary embodiment of a portion packaging according to the invention.
Figure 10B:
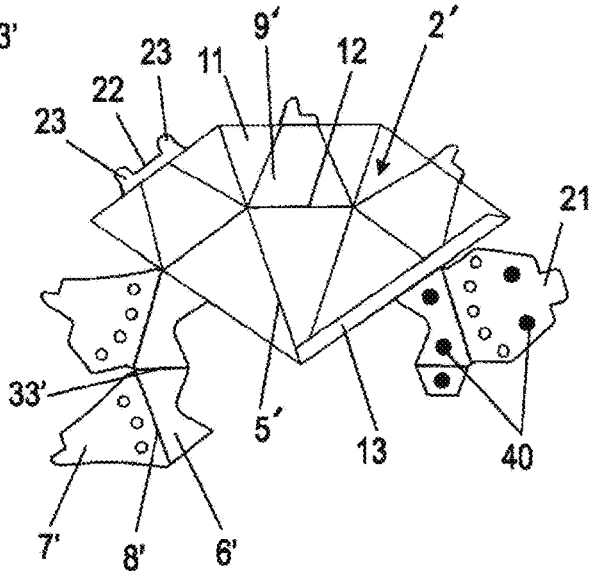
Figure 10C:
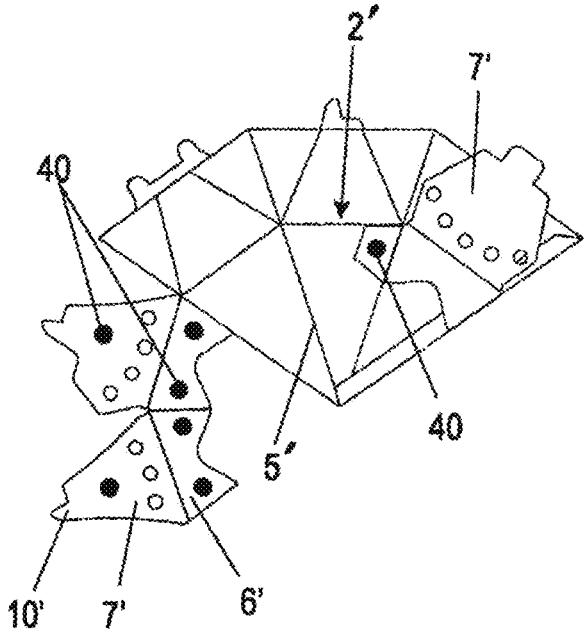

In FIGS. 10A to 10D, a further exemplary embodiment of a modified portion packaging 1' is shown during assembly. FIG. 10A shows a container 2' of the portion packaging 1' loose from a support body 3' of the portion packaging, whereas FIG. 10B shows the container 2' in the support body 3'. The container 2' made of a liquid-permeable filter material, in particular filter paper, comprises a plurality of triangular side walls joined together by folded side edges 5'. In the assembled position, the container 2' is pyramid-shaped with a downwardly directed tip 4'. Each side wall is connected at the upper end via a folded edge 12 to a flap-shaped cover 9'. The folding edges 12 are substantially arranged annularly in the use position. Each cover 9* is connected to an adjacent cover 9' via a section of the side edge 5', and has a triangular section 11 adjacent the side edge 5' to facilitate folding the cover 99' into the closed position. A connecting web 13 is further formed on the blank of the container 2, at which two opposite ends of the blank can be fixed to each other, in particular glued.

The portion packaging 1' further comprises a support body 3' having lateral sections 6' connected by a folding edge 8' to a respective pivotable arm 7', which is substantially triangular in shape. One or more openings or recesses 19' are formed on each of the arms 7' to facilitate entry of water into the container 2. Lateral sections 6' are each connected to one another by a folding edge 33', which is arranged parallel to a side edge 5' of the container 2'.

As shown in FIGS. 10E-10I, the six arms 7', include two arms 7 of each of four arms 7' interlocked in each case with one another via end closure means 10'. Each locking element 10' comprises a guide edge 16' and a latching projection 17' projecting at an angle thereto. The two latching projections 17', which rest against one another, ensure that the two arms 7' are supported against one another when a force is applied.

Two opposite arms T are each locked together and are thus arranged in one plane. Two further arms 7' are placed loosely on the already locked arms 7' and then form a second plane in the locked position. In each of the two planes, two arms T in each case prevent the container 2 from being pressed in by a force, wherein the two interlocked arms 7' provide support, in particular perpendicular to their folding edge 8'.

The last two arms 7' can optionally also have locking elements 10', but in the exemplary embodiment shown they are only provided with guide means. One arm 7' has a strip-shaped web 21 at the end, which can be inserted at a receptacle 22 formed by two projections 23 on the other arm 7. The projections 23 and the web 21 merely guide the opening movement when the arms 7' are unfolded. Locking is effected here, for example, by a separate element, such as an adhesive label, which is soluble when hot water is applied in order to move the two uppermost arms 7' into the opening position by swelling processes on the support body in the region of the folding edge 8' after the adhesive connection has been released. The arms 7' then pull the covers 9' into an unfolded position through the connections 11 with the covers 9'.

As shown in FIG. 10A, the support body 3', a recess 20' is also formed on each section 6' in a central region, so that the lower edge of the sections 6' is wave-shaped. The recess 20' in a central area results in better flowability of the filter material in this area.

Figure 10D:
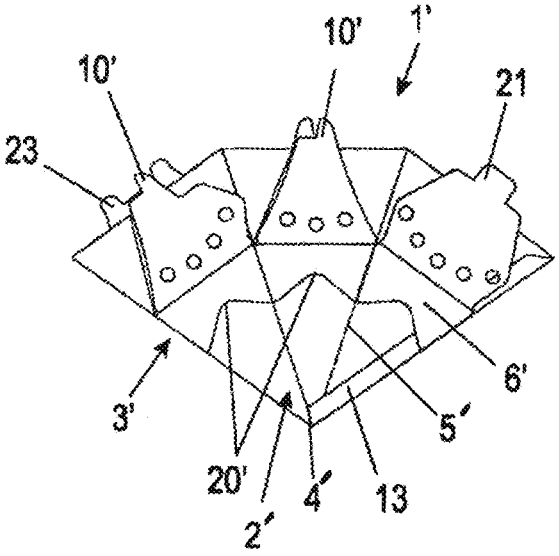

In FIG. 10A, the container 2' made of filter material has been placed m the support body 3' and can be glued there, w herein the gluing points 40 are drawn in black. Bonding of the filter material takes place both in the area of the sections 6' and in the area of the arms 7' of the support body 3'. In addition, the support body 3' is glued to a connecting web 30' in order to first fold it (FIG. 10C) and then arrange it in a ring shape, as shown in FIG. 10D.

Figure 10F:
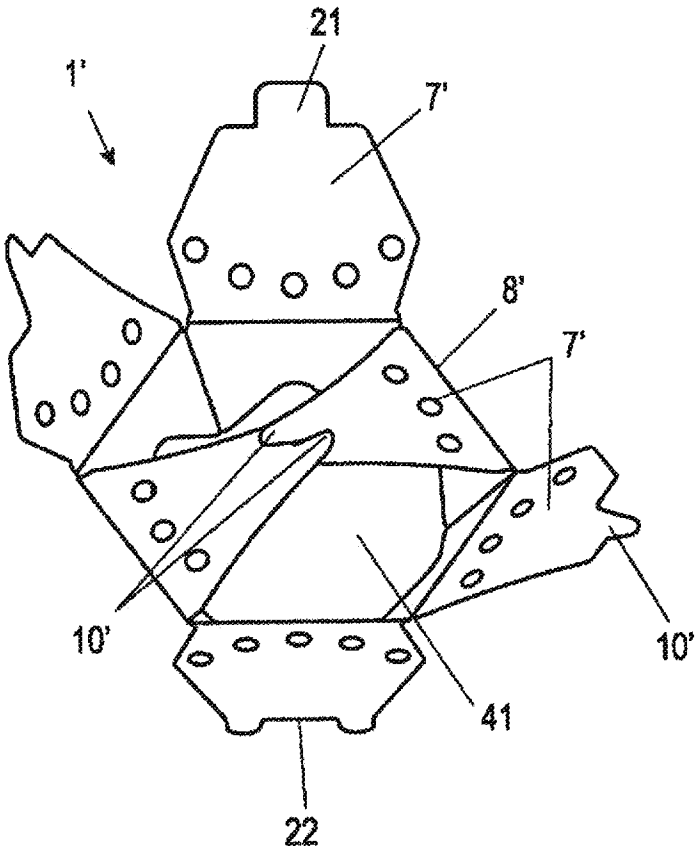
Figure 10E:
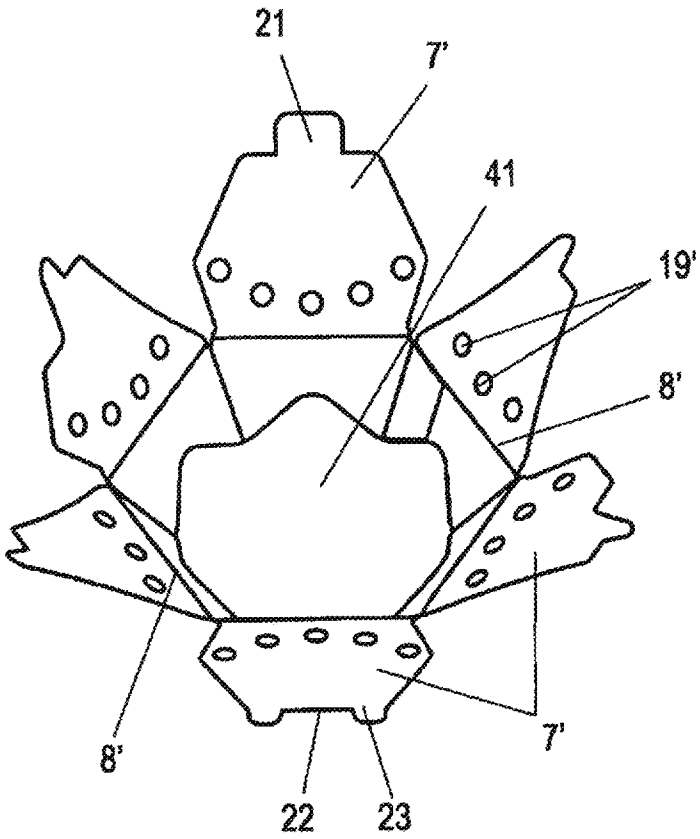
Figure 10G:
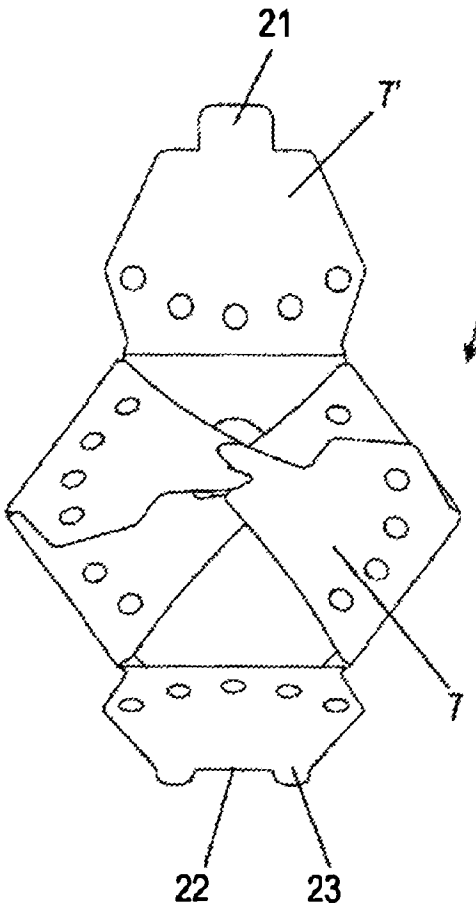
Figure 10H:
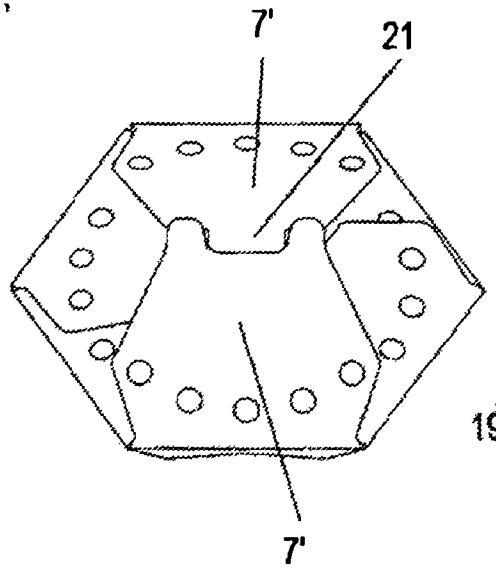
Figure 10I:
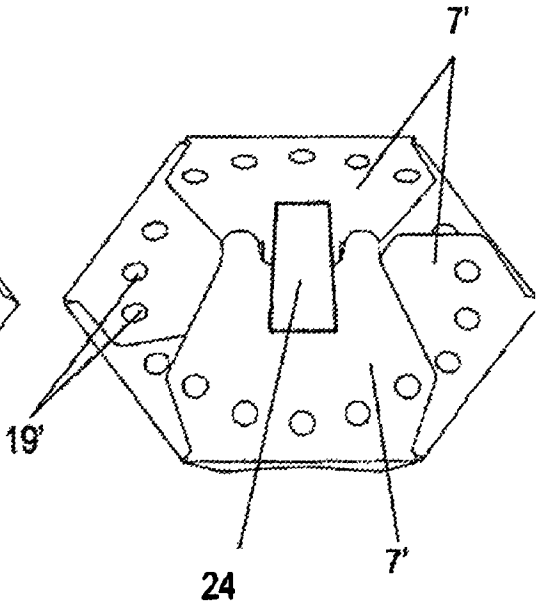

After a blank has been produced from the filter material of the container 2' and the support body 3', an interior space of the container 2' can now be filled with an extraction material 41. in particular coffee grounds, as shown in FIG. 10E. Subsequently, the closing of the arms T begins, wherein first a first pair of arms 7 is locked via the end-side locking means 10 (FIG. 10F). As shown in FIG. 10G. two further arms 7 are now placed loosely on the first plane with two locked arms 7 and locked together, so that a second plane consisting of two arms 7 is formed.

Now the last two arms 7 are loosely placed on the two arms 7 which are provided with interlocking locking elements. The strip-shaped web 21 is inserted into receptacle 22 between the two projections 23 (FIG. 10H) and then the last two arms 7 are fixed to each other by means of a water-releasable adhesive label 41. as shown in FIG. 101. The last two arms 7' also form a reinforcement by supporting the edge on the web 21 and the edge on the receptacle 22 w hen loaded by a force perpendicular to their folding edge 8'.

As in the previous embodiment, the portion packaging 1' is opened by unfolding the pairs of arms 7' one after the other.

Figure 11A:
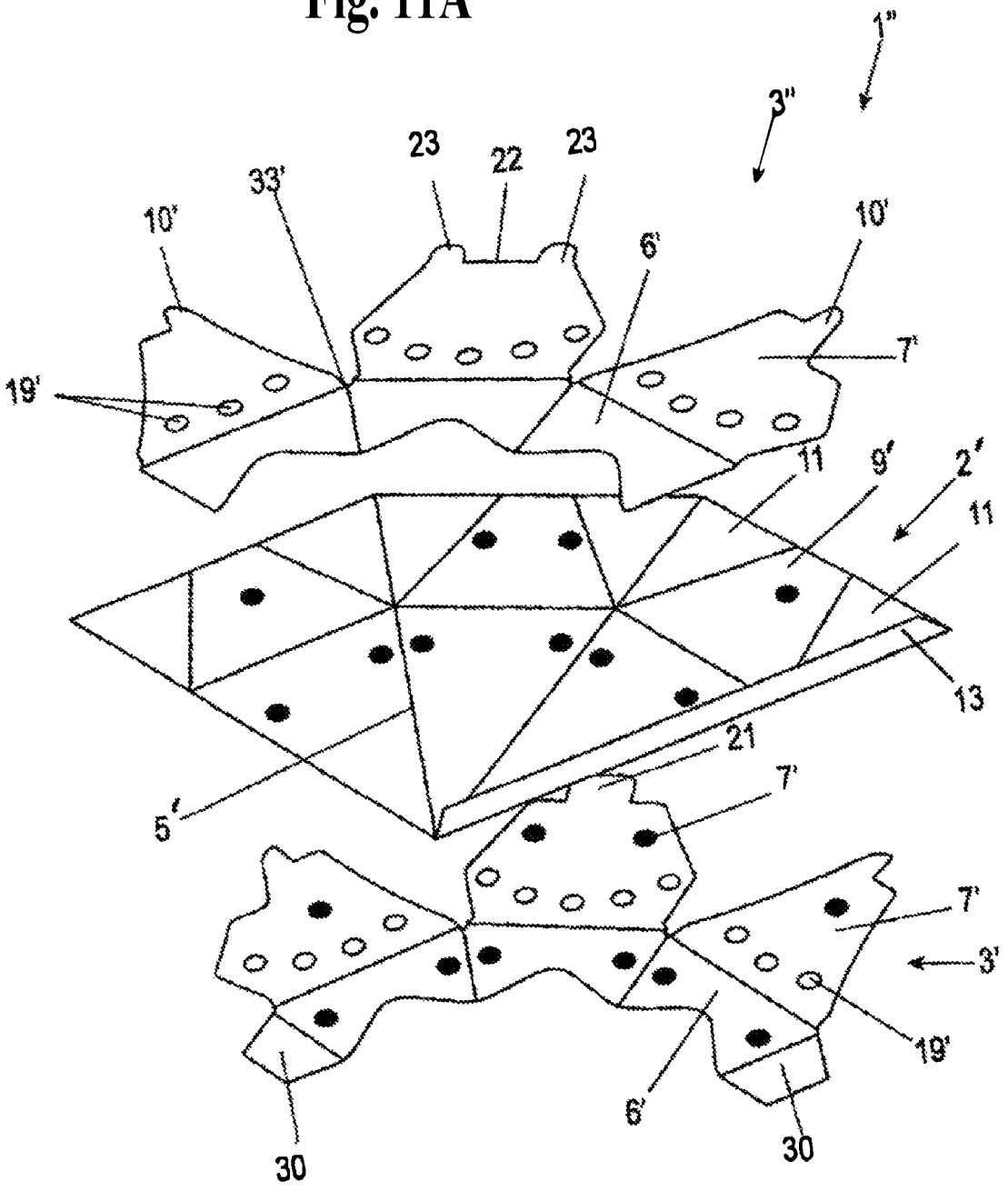
FIGS. 11A to 11C show several views of an embodiment similar to FIG. 10.
Figure 11C:
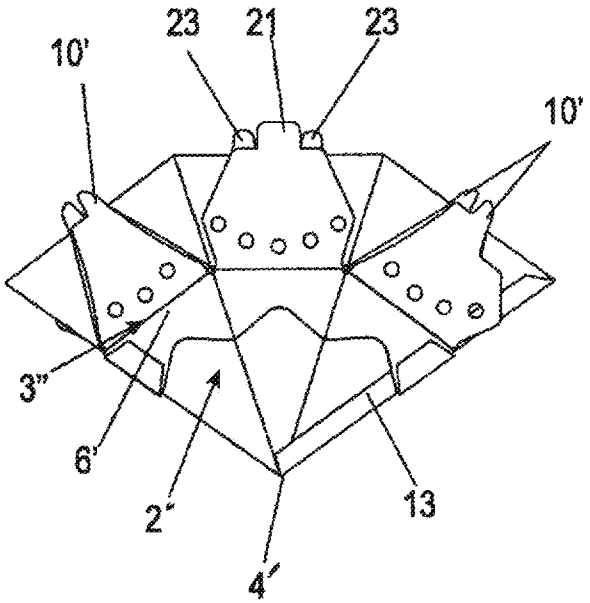
Figure 11B:
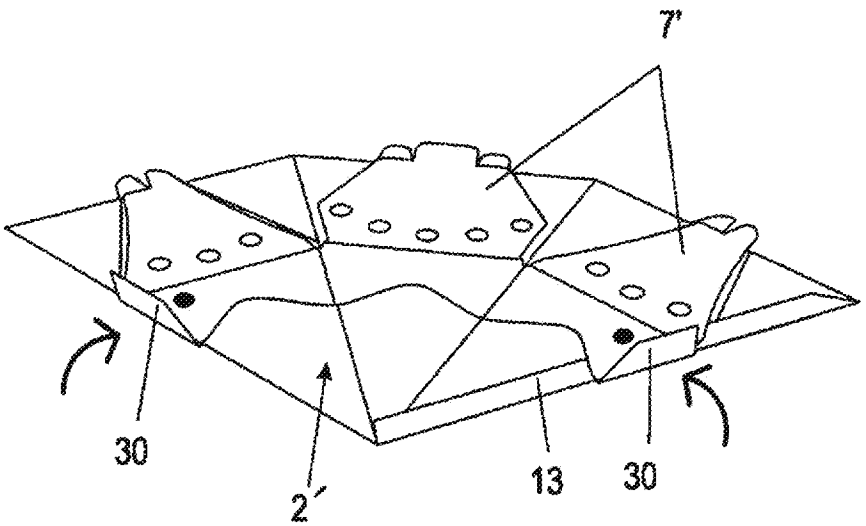

FIGS. 11A to 11C show another exemplary embodiment of a portion packaging 1", which is formed as in FIGS. 10A-10I, except for die two-part formation of the support body 3", which is formed from two parts and is therefore glued to one part at two opposite connecting webs 30. The container 2 made of filter material is formed as in FIGS. 10A-10I.

The invention claimed is:

1. A portion packaging for production of a beverage from an extraction material, the portion packaging comprising:

a container made of filter material in which the extraction material is arranged, the container comprising a plurality of side walls connected together via common side edges between adjacent side walls; and an annular shaped support body comprising a plurality of cardboard sections, wherein each of the side walls of the container is glued to a separate one of the cardboard sections of the support body and the support body additionally includes a plurality of pivotable arms bonded to the filter material of the container and being pivotable from a closed position closing the container into an open position for opening the container, wherein the plurality of pivotable arms of the support body are arranged on top of one another in at least a first plane and a second plane in the closed position of the container, wherein each of the plurality of pivotable arms has a free end shaped to form a locking element such that in the closed position of the container at least two of the plurality of pivotable arms are mutually interlocked with one another in the first plane via respective ones of the locking elements of the at least two pivotable arms in the first plane and at least an additional two of the plurality of pivotable arms are mutually interlocked with one another via the respective locking elements of the additional two of the plurality of pivotable arms in the second plane.

2. The portion packaging according to according to claim 1, wherein the portion packaging in the closed position of the container has a shape of a pyramid having a tip, wherein the plurality of pivotable arms of the support body are on a side of the portion packaging opposite to the tip of the pyramid.

3. The portion packaging according to claim 1, wherein each arm of the plurality of pivotable arms is formed substantially as a triangular flap.

4. The portion packaging according claim 1, wherein the support body is in one piece and includes lateral sections connected to the plurality of pivotable arms via respective folding edges.

5. The portion packing according to claim 1, wherein the support body is arranged annularly around the filter material.

6. The portion packaging according to claim 1, wherein the plurality of pivotable arms of the support body includes six pivotable arms and at least two of the six pivotable arms are interlocked with one another via the locking elements of the at least two pivotable arms in each of the at least first and second planes.

7. The portion packaging according to claim 1, wherein the plurality of pivotable arms of the support body includes two uppermost pivotable arms in the closed position of the container and the locking element of each of the two uppermost pivotable arms is shaped to provide guidance of the other one of the two uppermost pivotable arms during an unfolding of the two uppermost pivotable arms.

* * * * *